US005101777A

United States Patent [19]

Onishi et al.

[11] Patent Number: 5,101,777

[45] Date of Patent: Apr. 7, 1992

[54] AUTOMOBILE ENGINE STRUCTURE

[75] Inventors: Yoichi Onishi; Junkichi Amano, both of Iwata, Japan

[73] Assignee: Yamaha Hatsudoki Kabushiki Kaisha, Iwata, Japan

[21] Appl. No.: 677,256

[22] Filed: Mar. 29, 1991

Related U.S. Application Data

[63] Continuation of Ser. No. 482,233, Feb. 20, 1990, abandoned.

[51] Int. Cl.[5] ..... F01L 1/26

[52] U.S. Cl. ..... 123/90.23; 123/90.23

[58] Field of Search ..... 123/90, 22, 90.23, 90.27, 123/90.31, 90.44, 55 VF, 55 VS, 55 VE, 308, 315, 432

[56] References Cited

U.S. PATENT DOCUMENTS

| | | | |
|---|---|---|---|
| 1,306,949 | 6/1919 | Coatalen | 123/90.22 |
| 4,721,074 | 1/1988 | Wirth et al. | 123/90.23 |
| 4,739,735 | 4/1988 | Ichida et al. | 123/90.23 |
| 4,773,360 | 9/1988 | Heimburg | 123/90.23 |
| 4,840,152 | 6/1989 | Watanabe et al. | 123/52 MV |

FOREIGN PATENT DOCUMENTS

| | | | |
|---|---|---|---|
| 3741923 | 6/1988 | Fed. Rep. of Germany | 123/90.27 |

*Primary Examiner*—Noah P. Kamen
*Attorney, Agent, or Firm*—Ernest A. Beutler

[57] ABSTRACT

Several embodiments of V type internal combustion engines having multiple valves per cylinder and an overall compact arrangement. This is achieved by employing only a single camshaft for operating all of the valves of each cylinder head and the axis of rotation of the camshafts is offset toward the valley side of the cylinder head. Various valve arrangements are disclosed in operating mechanisms.

18 Claims, 7 Drawing Sheets

AUTOMOBILE ENGINE STRUCTURE

This is a continuation of U.S. patent application Ser. No. 07/482,233, filed Feb. 20, 1990, now abandoned.

BACKGROUND OF THE INVENTION

This invention relates to an automobile engine structure and more particularly to an improved, compact V type engine for automotive application.

It is well known that V type engines have certain spatial advantages in that they occupy less length than an in line type of engine. However, because of its very nature, the V type engine has a greater width than an in line engine. As the valve train associated with the engine becomes more complex, the width of the engine obviously will increase. The increased width of the engine obviously presents a number of disadvantages. This is particularly true with transverse engine placement within the engine compartment.

The use of multiple valves per cylinder also gives rise to considerable complexity in the valve train mechanism and can add to the width of the engine. This is particularly true if double overhead camshafts are employed for each cylinder bank.

It is, therefore, a principal object of this invention to provide an improved, compact construction for a V type engine.

It is a further object of this invention to provide an improved valve train mechanism for a V type engine that permits the use of multiple valves and which, at the same time, does not significantly increase the width of the engine.

It is a further object of this invention to provide an improved V type of engine and camshaft and valve train arrangement therefor.

SUMMARY OF THE INVENTION

This invention is adapted to be embodied in a V type internal combustion engine having a pair of angularly disposed cylinder banks. A pair of cylinder heads are each affixed to a respective one of the cylinder banks. A pair of camshafts are each journaled for rotation relative to a respective one of the cylinder heads about an axis that is disposed on the side of the respective cylinder head adjacent the apex of the angle between the cylinder blocks.

DETAILED DESCRIPTION OF THE PREFERRED EMBODIMENTS OF THE INVENTION

Figure 1:
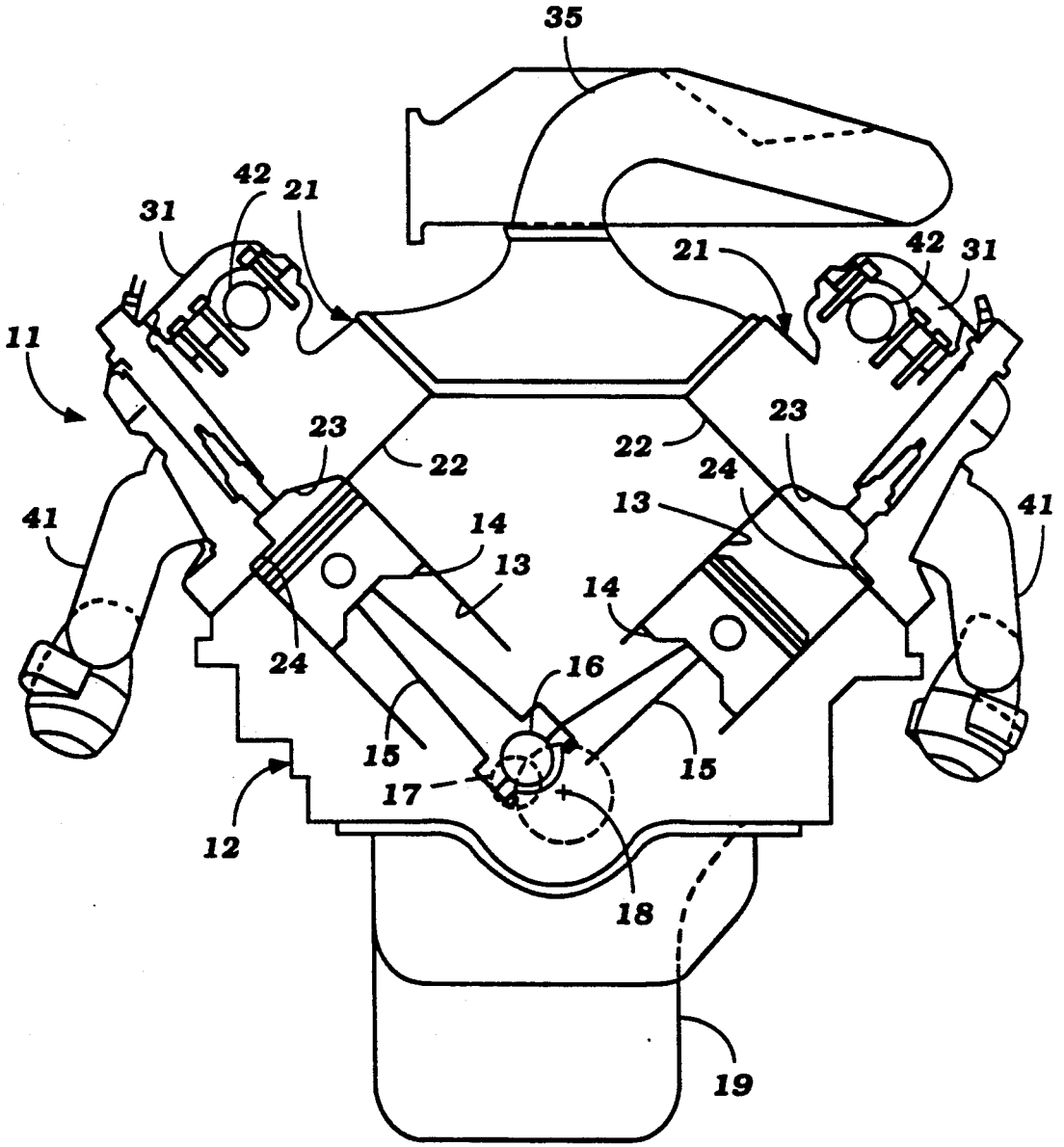
FIG. 1 is a schematic front elevational view of an internal combustion engine constructed in accordance with an embodiment of the invention.
Figure 2:
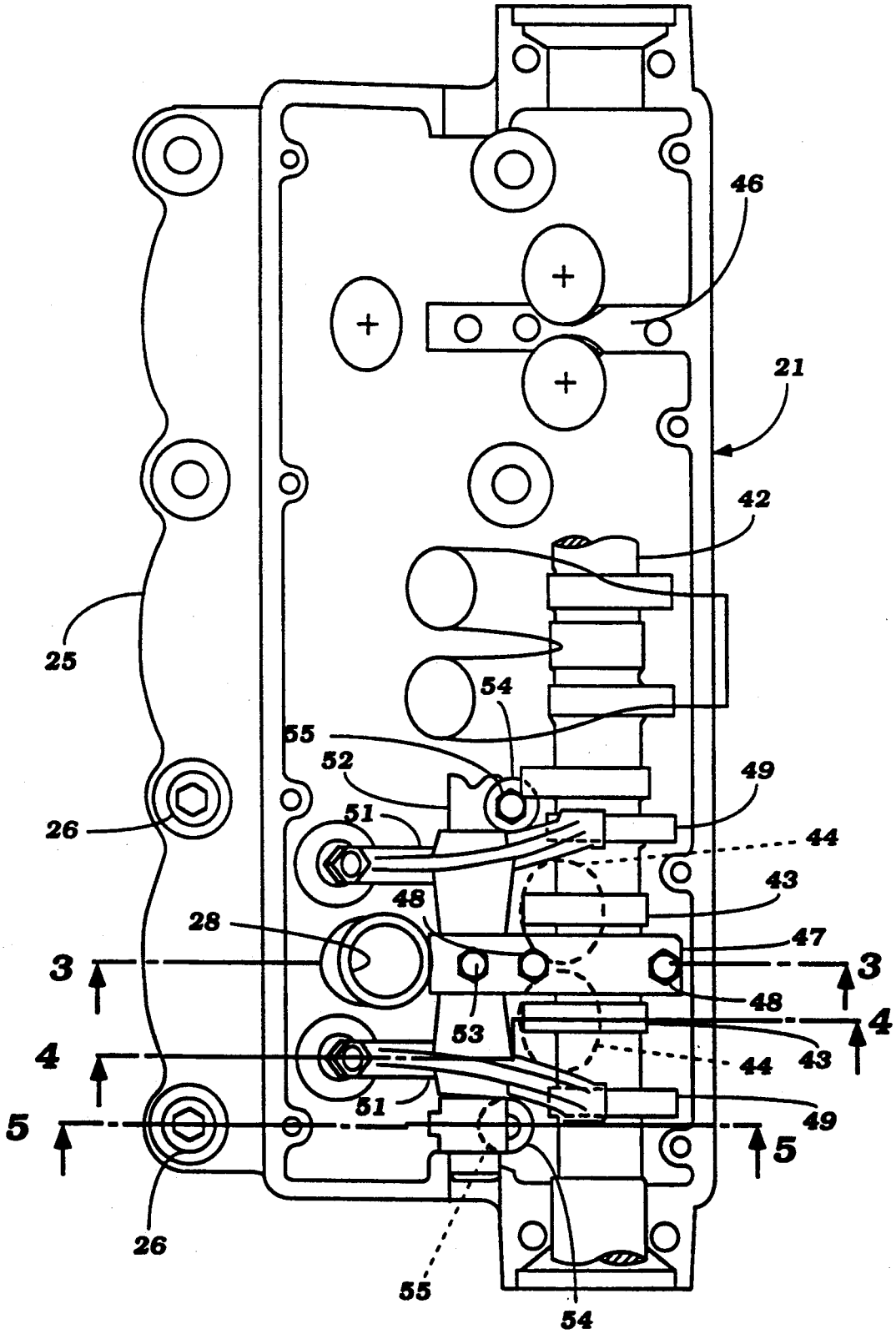
FIG. 2 is a top plan view of the left hand cylinder bank of the engine with the cam cover and certain of the components removed and other portions broken away.

Referring now in detail to the drawings and initially primarily to FIG. 1, an internal combustion engine constructed in accordance with an embodiment of the invention is identified generally by the reference numeral 11. In the illustrated embodiments, the engine 11 is of the V-6 type. It is to be understood, however, that the invention can be practiced in conjunction with engines having other numbers of cylinders. The invention, however, has particular utility in conjunction with V type engines and those operating on the four stroke cycle. The engine 11 has a cylinder block 12 having angularly disposed cylinder banks in which cylinder bores 13 are formed. Pistons 14 reciprocate in these cylinder bores and are connected by means of connecting rods 15 to respective throws 16 and 17 of a crankshaft, indicated generally by the reference numeral 18 and rotatable about an axis disposed at the center thereof.

In the illustrated embodiment, the crank throws 16 and 17 are eccentrically disposed relative to each other so that the connecting rods 15 are journaled in relative side by side positions, but slightly offset relative to each other. This is because the engine, in the illustrated embodiment, is a 90° V-6. The staggering between the throws 16 and 17 is to compensate for the difference in the angle from the normal 60° angle employed with a V-6 engine of this type. However, the invention can be utilized equally as well with engines wherein the cylinder banks are disposed at an angle to each other equivalent to the firing angle so that the connecting rods 15 will be journaled in side by side relationship on a common throw.

The crankshaft 18, as has been noted, is rotatably journaled in any appropriate manner and is contained within a crankcase 19 that is affixed to the lower side of the cylinder block 12 in a known manner. It is to be understood that the basic engine construction consisting of the cylinder block, pistons, connecting rods, crankshaft and crankcase may be of any conventional type. The invention relates to the cylinder head assemblies, indicated generally by the reference numeral 21 that are affixed to the cylinder block 12 in a manner to be described and the valve train associated therewith.

Referring now in more detail to FIGS. 2 through 6, the construction of the cylinder head assemblies 21 will be described in more detail. These figures illustrate the left hand bank cylinder head but it should be readily apparent to those skilled in the art that the construction of the right hand cylinder bank is the same but reversed.

The cylinder head 21 has a lower surface 22 that is adapted to engage the upper surface of the cylinder block and specifically the banks thereof to provide a seal around the cylinder bores 13. There is provided a combustion chamber recess 23 in the surface 22 which is offset slightly toward the valley of the V of the engine with a clearance or squish area 24 formed to the outer side of the cylinder bores 13. Because of the offset of the combustion chamber recesses 23, the cylinder head 21 is provided with an offset flange portion 25 that overlies the outer end of the cylinder block 12 and which passes threaded fasteners 26 for partially providing the securement of the cylinder head 21 to the cylinder block 12. These threaded fasteners 26 are accessible externally of the cylinder head assembly as should be readily apparent from FIGS. 2 and 5.

Figure 3:
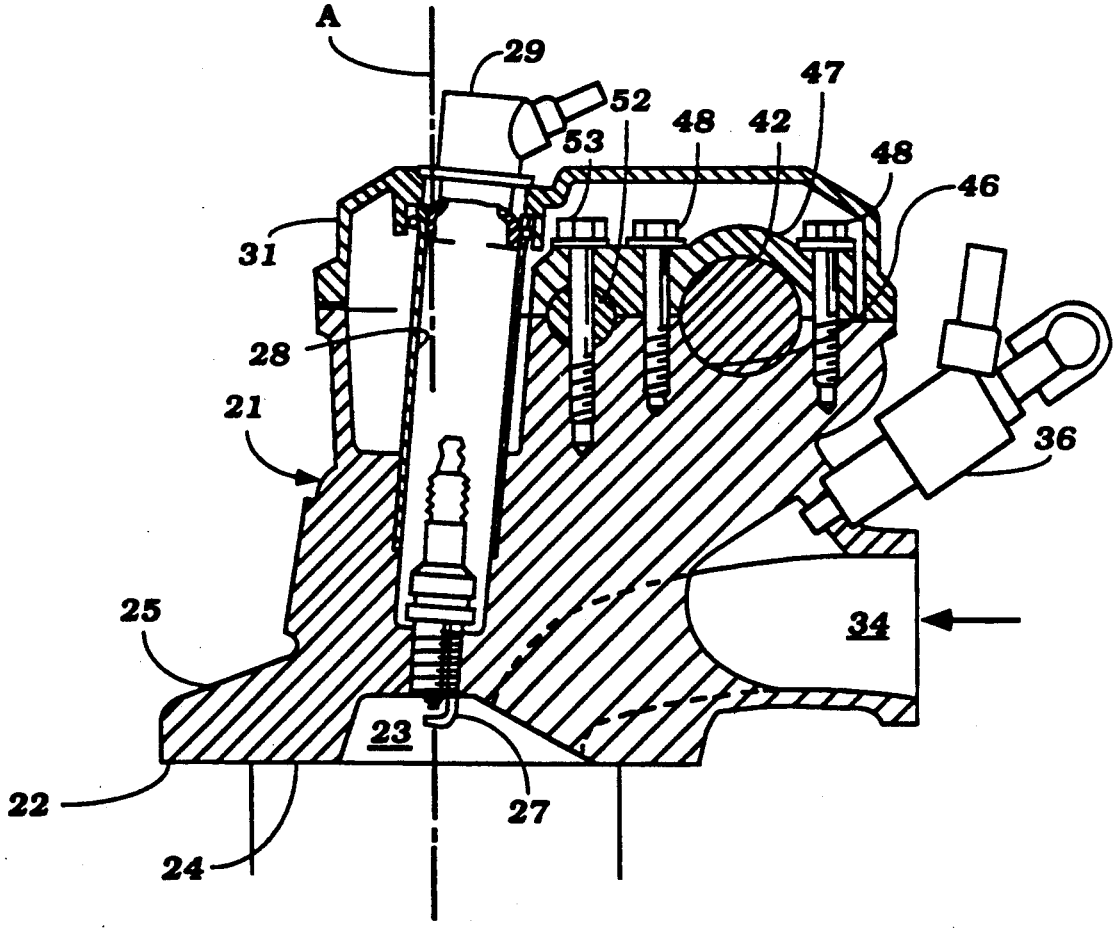
FIG. 3 is a cross sectional view taken along the line 3—3 of FIG. 2.
Figure 4:
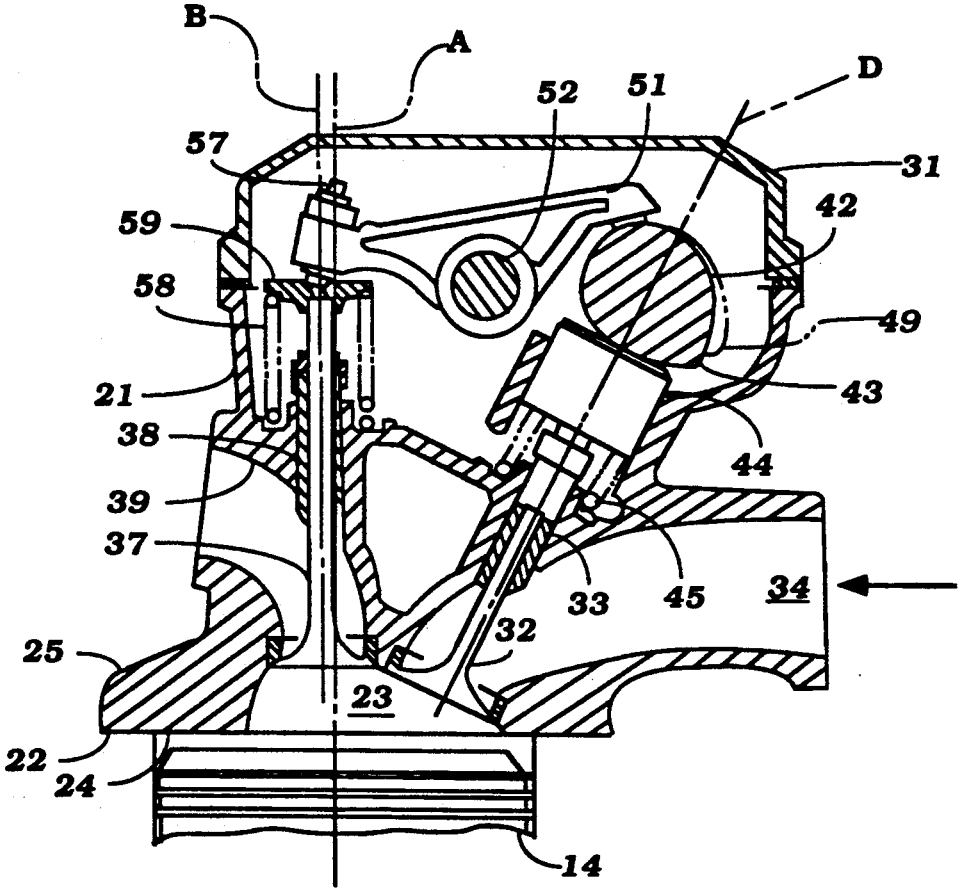
FIG. 4 is a cross sectional view taken along the line 4—4 of FIG. 2.
Figure 5:
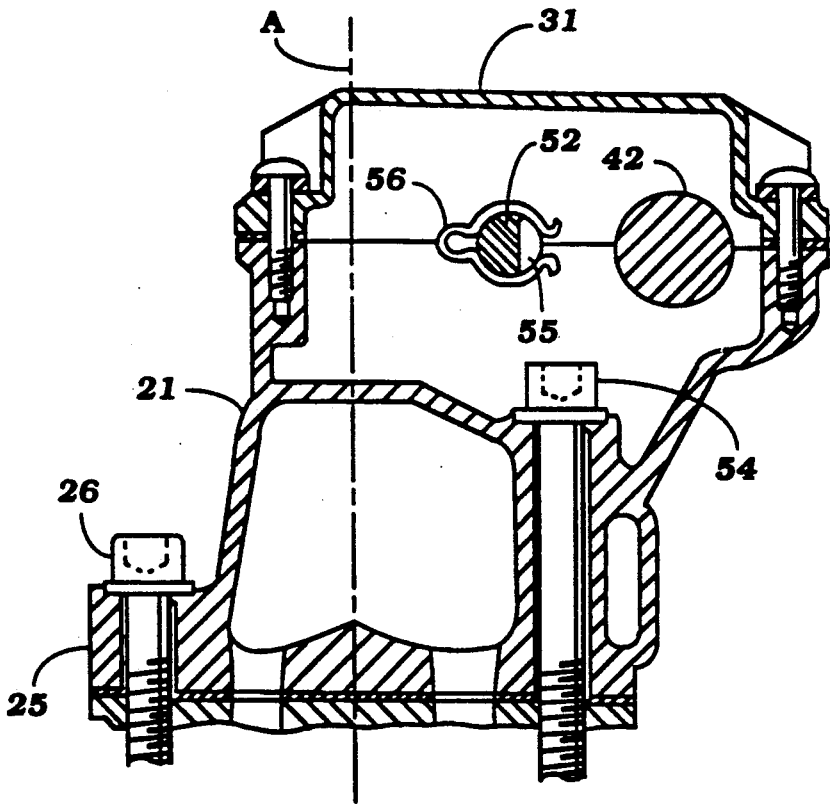
FIG. 5 is a cross sectional view taken along the line 5—5 of FIG. 2.

As should be evident from FIGS. 3 through 5, the combustion chamber recess 23 is disposed in a somewhat offset manner relative to the cylinder bore axis A. A spark plug 27 is positioned in the cylinder head 21 with its gap lying substantially on the axis of the cylinder bore A (FIG. 3). The spark plug associated with each cylinder is accessible through a spark plug well 28 formed in part by an inserted sleeve and which is disposed at a slight angle to the axis A for accessibility. A spark plug terminal 29 is affixed to the upper end of the well and cooperates with the terminal of the spark plug 27 for its firing in a known manner. It should be noted that the terminal 29 is received in a recess formed in a cam cover 31 which is fixed to the cylinder head 21 and which encloses the valve train which will now be described.

Figure 6:
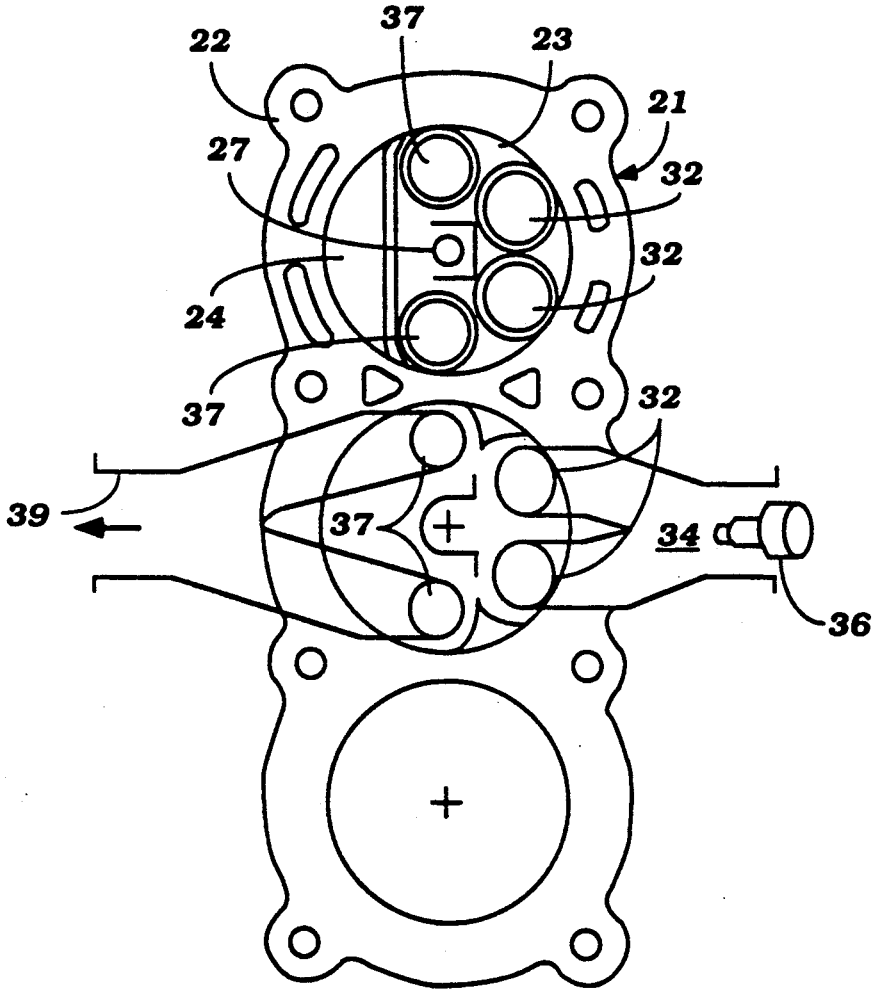
FIG. 6 is a bottom plan view of the cylinder head with portions shown schematically.

As may be best seen in FIGS. 4 through 6, a pair of intake valves 32 are supported for reciprocation within the cylinder head assembly 21 at one side of the bore axis A. These intake valves 32 have stem portions that are slidably supported in pressed in guides 33 and reciprocate about axes that are disposed at an angle to the cylinder bore axis A, these axes of reciprocation being identified by the reference character D. The intake valves 32 control the admission of a charge to the combustion chamber 23 through a siamese intake port 34 that opens through the valley of the engine and which is served by an induction system which may be of any known type and which is identified generally by the reference numeral 35. A fuel injection nozzle 36 is positioned in the siamese portion of the intake port 34 for delivering fuel to the combustion chamber 23 through both of the intake valves 32 when they are open. It is to be understood, of course, that other forms of charge forming systems may be employed.

A pair of exhaust valves 37 are supported for reciprocation about generally vertically extending axes identified by the lines B and are disposed in a slightly offset direction relative to the cylinder bore axis A and a longitudinally extending plane containing it from the intake valves 32 as best shown in FIG. 4. The intake valves 37 are slidably supported for reciprocation along the axes B by pressed in guides 38 contained within the cylinder head. It should be noted that the exhaust valves 37 are disposed on opposite sides of the spark plug 27 as may be best seen in FIG. 6.

The exhaust valves 37 control the flow through a siamese exhaust port 39 which, in turn, delivers the exhaust gases from the combustion chamber 23 to respective exhaust manifold assemblies 41 (FIG. 1) affixed to the outer side of the cylinder head assemblies 21 in a known manner.

In accordance with a feature of the invention, both the intake valves 32 and exhaust valves 37 are operated by a single camshaft 42 that is rotatably journaled in the cylinder head assembly 21, in a manner to be described, with the axis of rotation thereof extending parallel to the axis of rotation of the crankshaft 18 but offset from the cylinder bore axis A toward the valley of the V. The camshafts 42 are offset to the degree that they are located totally to the sides of the cylinder bores. In accordance with a feature of the invention, the axis of reciprocation of the intake valves 32 D intersects this axis of rotation of the camshafts 42 so as to allow their direct actuation in a manner to be described. As will be noted from FIGS. 2 and 4, the camshaft 42 has a plurality of individual intake lobes 43 that are engaged with thimble tappets 44 supported for reciprocation within the cylinder head 21 and cooperating with the intake valves 32 in a known manner for effecting their opening. Coil compression springs 45 are associated with each of the intake valves 32 for urging them to their closed positions.

The camshaft 42 has spaced bearing surfaces formed along its length. These bearing surfaces cooperate with bearing surfaces 46 formed integrally in the cylinder head assembly and with which bearing caps 47 cooperate so as to complete the journaling of the camshaft 42. The bearing caps 47 are affixed to the cylinder head assembly 21 by threaded fasteners 48.

In addition to the intake lobes 43, the camshaft 42 is formed with exhaust lobes 49 that cooperate with the follower portions of rocker arms 51 that are journaled on a rocker arm shaft 52. The rocker arm shaft 52 is also journaled by the cylinder head 21 and the bearing caps 47. Further threaded fasteners 53 extend through the rocker arm shafts 52 for holding them in position and for securing the bearing caps 47 in place.

The cylinder head 21 is further held to the cylinder block by a second row of threaded fasteners 54 which are contained within the valve cover and which partially underlie the rocker arm shaft 52. These threaded fasteners 54 are spaced an equal distance on the opposite side of the cylinder bore axis A from the threaded fasteners 26 so as to provide good hold down characteristics. In the area where the rocker arm shaft 52 overlies the threaded fasteners 54, the rocker arm shaft is provided with reliefs 55 (FIG. 5). Removable clips 56 may overlie some of the reliefs 54 to axially locate the rocker arms 51. These clips 56 may be readily removed without special tools for cylinder head torque down.

As may be seen in FIG. 4, the rocker arms 51 carry adjusting screws 57 at their outer ends which cooperate with the tips of the exhaust valves 37 for effecting their opening. Coil compression springs 58 and keeper assemblies 59 act to urge the exhaust valves 32 to their closed positions. Adjustment of the clearance of the intake valves 32 may be achieved in any known manner as by replaceable shims or the like.

Figure 7:
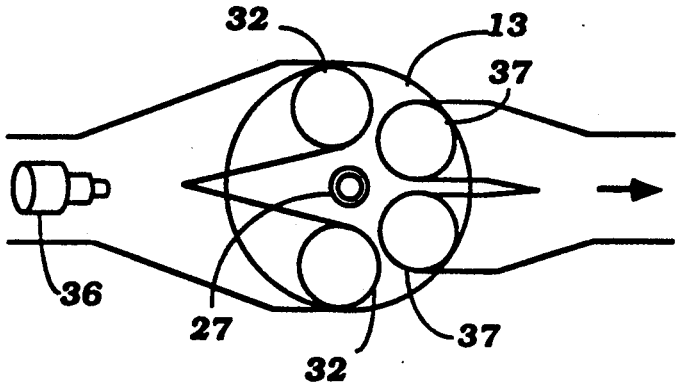
FIG. 7 is a bottom plan view of the right hand bank cylinder head of an engine constructed in accordance with another embodiment of the invention.

In the embodiment as thus far described, the induction system has been positioned in the valley of the V of the engine and the exhaust system has been provided on the outboard side of the cylinder head assemblies. Of course, it is possible to reverse the arrangement and FIG. 7 is a schematic top plan view showing such a reversal. In this embodiment, it will be noted that the fuel injection nozzle 36 is positioned on the outboard side of the engine and, accordingly, the intake valves 32 are provided slightly offset from the axis of the cylinder bore axis. The exhaust valves 37, on the other hand, are provided with inclined axes of reciprocation and discharged to an exhaust manifold assembly (not shown) that is positioned in the valley of the V. In all other regards, this embodiment is the same as those previously described and, for that reason, further description of this embodiment is not believed to be necessary.

Figure 8:
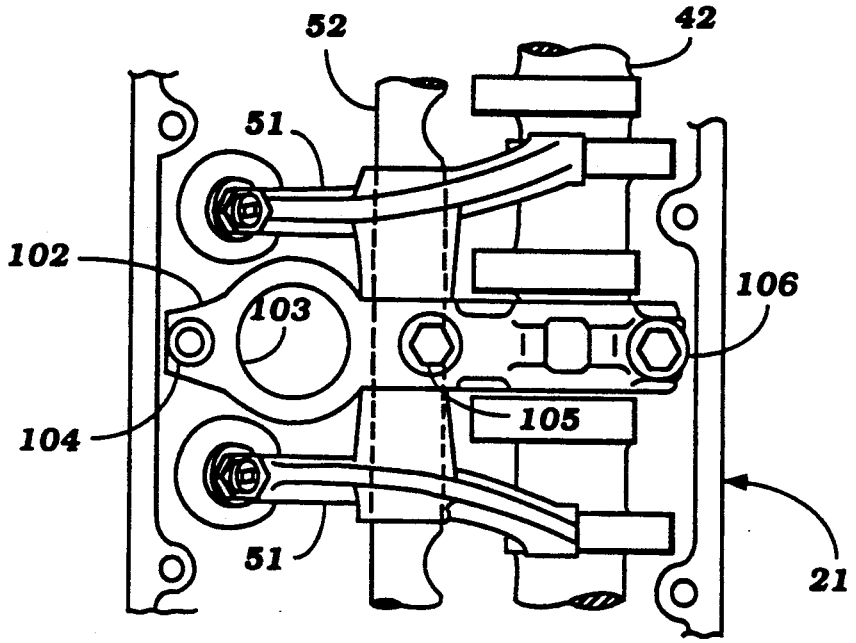
FIG. 8 is a partial top plan view, in part similar to FIG. 2, and shows another embodiment of the invention.
Figure 9:
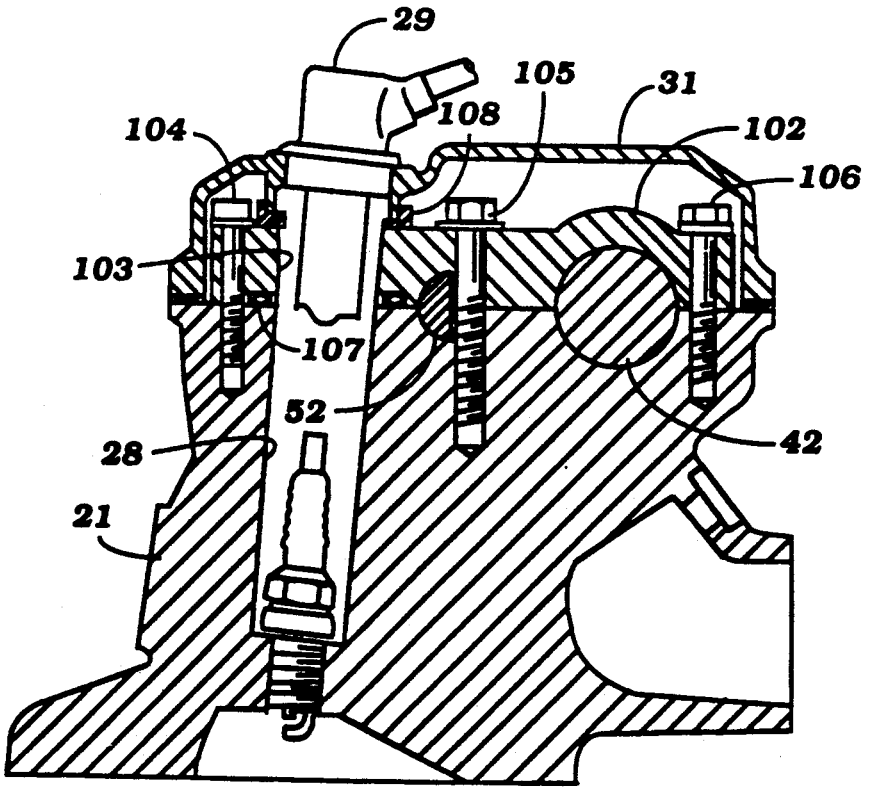
FIG. 9 is a cross sectional view along a plane corresponding to the plane of FIG. 3 of the previously described embodiment but showing this embodiment.

In the embodiments of the invention as thus far described, the bearing caps 47 have terminated short of the spark plug wells 28. It is, of course, possible to extend these bearing caps so that they will form a portion of the spark plug well. FIGS. 8 and 9 show such an embodiment. Because this embodiment is otherwise generally the same as that previously described, components which are the same or essentially the same have been identified by the same reference numerals and will not be described again, except insofar as is necessary to understand the construction and operation of this embodiment.

In this embodiment, there are provided bearing caps 102 that extend across beyond the rocker arm shaft 52 and which define portions 103 of the spark plug well 28 as clearly shown in FIG. 9. Three threaded fasteners 104, 105 and 106 cooperate with the bearing cap 102 to retain it in position. The fastener 104 is positioned on the intake or valley side of the cylinder head 21 outside of the spark plug well 103. The fastener 105 extends through the rocker arm shaft 52 while the fastener 106 is positioned in the same location as the corresponding fastener 48 of the previously described embodiment.

In order to assist in sealing, an 0 ring seal 107 surrounds the lower portion of the bearing cap 102 around the spark plug well 103 and an upper seal 108 is provided on the top of the bearing cap 102 and is compressed between the bearing cap 102 and the cam cover 31. In all other regards, this embodiment is the same as those previously described and, for this reason, further description of this embodiment is not believed to be required.

In view of the foregoing, it should be readily apparent that the several embodiments of the invention as illustrated and described are highly useful in providing a very compact V type of engine employing multiple overhead valves, all operated only by a single camshaft. Although a number of embodiments have been illustrated and described, various changes and modifications may be made without departing from the spirit and scope of the invention, as defined by the appended claims.

We claim:

1. A V type internal combustion engine having a pair of angularly disposed cylinder banks defining respective cylinder bores with a valley disposed between said cylinder banks, a pair of cylinder heads, each affixed to a respective one of said cylinder banks, each cylinder head defining a recess cooperating with an associated cylinder bore and piston to form a combustion chamber, at least one intake and exhaust valve for each cylinder bore, and a pair of camshafts each journaled for rotation relative to a respective one of said cylinder heads about an axis disposed on the side of said respective cylinder head adjacent said valley between the cylinder banks, wherein each camshaft drives both intake and exhaust valves, a plurality of fasteners for cooperating in journaling said camshafts, said camshaft axes being disposed in an offset relationship to the cylinder head recesses relative to the axis of reciprocation of the piston in the associated cylinder bore, and at least one cam lobe on each camshaft wherein said camshafts, said cam lobes and at least one fastener are completely disposed on the valley side of said associated cylinder bore.

2. A V type internal combustion engine as set forth in claim 1 wherein the combustion chamber includes a squish area formed only on the outside of said cylinder head recesses spaced from the camshafts.

3. A V type internal combustion engine as set forth in claim 2 further wherein the intake valve is supported for reciprocation within the cylinder head and inclined at an angle to the associated cylinder bore axis and offset to the side of the cylinder head adjacent the valley of the V and wherein said exhaust valve is supported for reciprocation about an axis that extends generally parallel to the cylinder bore axis and which is offset from the associated cylinder bore axis on the side opposite the intake valve is offset from the associated cylinder bore axis on the side opposite the intake valve.

4. A V type internal combustion engine as set forth in claim 3 wherein there are two intake valves and two exhaust valves, and wherein the intake valves are parallel and the exhaust valves are parallel.

5. A V type internal combustion engine as set forth in claim 4 further including a plurality of cam lobes on the camshaft, one for operating each of the valves.

6. A V type internal combustion engine as set forth in claim 5 wherein the intake valves are operated directly by the cam lobes and the exhaust valves are operated by rocker arms.

7. A V type internal combustion engine as set forth in claim 6 wherein the rocker arms are journaled for rotation about a rocker arm shaft, the rocker arms overlying in part fastening means for affixing the cylinder head to a cylinder block, the rocker arm shaft having reliefs for clearing the fastening means for permitting tightening of the fastening means with the rocker arm shaft in place, and further including detachable clip means affixed to the rocker arm shaft and overlying the fastening means.

8. A V type internal combustion engine as set forth in claim 1 wherein one of said intake and exhaust valves being operated directly by the respective camshaft and the other of the valves being operated by the respective camshaft via a rocker arm.

9. A V type internal combustion engine as set forth in claim 8 further including an intake valve supported for reciprocation within the cylinder head and inclined at an angle to the associated cylinder bore axis and offset to the side of the cylinder head adjacent the valley of the V and an exhaust valve supported for reciprocation about an axis that extends generally parallel to the associated cylinder bore axis and which is offset therefrom on the side opposite the intake valve.

10. A V type internal combustion engine as set forth in claim 9 wherein there are two intake valves and two exhaust valves, and wherein the intake valves are parallel and the exhaust valves are parallel.

11. A V type internal combustion engine having a pair of angularly disposed cylinder banks defining respective cylinder bores with a valley between said cylinder banks, a pair of cylinder heads, each affixed to a respective one of said cylinder banks, a pair of intake valves supported for reciprocation within the respective cylinder head and inclined at angles to the associated cylinder bore axis and offset to the side of the respective cylinder head adjacent said valley area and a pair of exhaust valves supported for reciprocation about axes that extend generally parallel to the associated cylinder bore axis and offset therefrom on the side opposite the intake valves, a pair of camshafts each journaled for rotation relative to a respective one of said cylinder heads about an axis disposed on the side of said respective cylinder head adjacent the valley between the cylinder banks, a plurality of fasteners for cooperating in journaling said camshafts, a plurality of cam lobes on each camshaft, and means for operating each of the valves from a respective one of the cam lobes, wherein said camshafts, said cam lobes and at least one fastener are completely disposed on the valley side of said associated cylinder bore.

12. A V type internal combustion engine as set forth in claim 11 wherein the cylinder head defines a cavity cooperating with an associated cylinder and piston to form the combustion chamber, said camshaft axes being disposed in an offset relationship to the cylinder head recesses relative to the axis of reciprocation of the piston of the associated cylinder bore.

13. A V type internal combustion engine as set forth in claim 12 wherein the cylinder head further forms a squish area on the outside of the cylinder head recesses.

14. A V type internal combustion engine as set forth in claim 11 wherein the intake valves are operated directly by the cam lobes and the exhaust valves are operated by rocker arms.

15. A V type internal combustion engine as set forth in claim 14 wherein the rocker arms are journaled for rotation about a rocker arm shaft, the rocker arm overlying in part fastening means for affixing the cylinder head to the cylinder block, the rocker arm shaft having reliefs for clearing the fastening means for permitting tightening of the fastening means with the rocker arm shaft in place, and further including detachable clip means affixed to the rocker arm shaft and overlying the fastening means.

16. A V type internal combustion engine as set forth in claim 11 further including a bearing surface formed on each camshaft between at least two of the cam lobes associated with each cylinder bore and bearing means affixed to said cylinder head and engaging said bearing surfaces for journaling said camshafts, said bearing means being formed within an opening therein for passing a spark plug mounted in the cylinder head.

17. A V type internal combustion engine as set forth in claim 16 wherein the intake valves are operated directly by the cam lobes and the exhaust valves are operated by rocker arms.

18. A V type internal combustion engine as set forth in claim 17 wherein the rocker arms are journaled for rotation about a rocker arm shaft, the rocker arm overlying in part fastening means for affixing the cylinder head to the cylinder block, the rocker arm shaft having reliefs for clearing the fastening means for permitting tightening of the fastening means with the rocker arm shaft in place, and further including detachable clip means affixed to the rocker arm shaft and overlying the fastening means.

* * * * *

UNITED STATES PATENT AND TRADEMARK OFFICE

CERTIFICATE OF CORRECTION

PATENT NO. : 5,101,777

DATED : April 7, 1992

INVENTOR(S) : Onishi, et al

It is certified that error appears in the above-identified patent and that said Letters Patent is hereby corrected as shown below:

Column 6, lines 6-7, Claim 3, delete "is offset from the associated cylinder bore axis on the side opposite the intake valve".

Signed and Sealed this

Seventh Day of September, 1993

Bruce Lehman

*Attest:*

BRUCE LEHMAN

*Attesting Officer*

*Commissioner of Patents and Trademarks*